United States Patent [19]

Herring, Jr.

[11] Patent Number: 4,712,488

[45] Date of Patent: Dec. 15, 1987

[54] ELASTOMERIC MEMBER HAVING FLEXIBLE WOVEN MATERIAL BONDED THERETO IN A RAILWAY TRUCK PRIMARY SUSPENSION SYSTEM

[75] Inventor: James M. Herring, Jr., Merion Station, Pa.

[73] Assignee: The Budd Company, Troy, Mich.

[21] Appl. No.: 905,602

[22] Filed: Oct. 24, 1986

Related U.S. Application Data

Substitution of Ser. No. 612,822, May 22, 1984, abandoned.

[51] Int. Cl.[4] ..... B61F 5/26

[52] U.S. Cl. ..... 105/224.1; 267/153

[58] Field of Search ..... 105/224.1; 428/159, 428/171, 251, 256, 285; 267/3, 63 R, 153

[56] References Cited

U.S. PATENT DOCUMENTS

| | | | |
|---|---|---|---|
| 1,825,530 | 9/1931 | Latshaw | 105/224.1 |
| 1,932,445 | 10/1933 | Burns | 105/224.1 |
| 2,062,469 | 12/1936 | Morgan | 428/492 |
| 2,136,440 | 11/1938 | Hufferd | 267/63 R |
| 2,642,920 | 6/1953 | Simon et al. | 428/251 |
| 2,728,700 | 12/1955 | Gatke | 428/256 |
| 2,740,739 | 4/1956 | Harwin et al. | 428/159 |
| 4,044,689 | 8/1977 | Eggert, Jr. | 105/224.1 |
| 4,120,605 | 10/1978 | Hurst | 428/256 |
| 4,121,008 | 10/1978 | Seddon | 428/251 |
| 4,278,726 | 7/1981 | Wieme | 428/251 |
| 4,444,122 | 4/1984 | Dickhart, III | 267/3 |

FOREIGN PATENT DOCUMENTS

| | | | |
|---|---|---|---|
| 629917 | 10/1961 | Canada | 428/251 |
| 806357 | 12/1936 | France | 267/63 R |
| 331151 | 10/1935 | Italy | 267/63 R |
| 19153 | of 1912 | United Kingdom | 428/256 |
| 800769 | 9/1958 | United Kingdom | 428/251 |

*Primary Examiner*—Robert B. Reeves
*Assistant Examiner*—John G. Pido
*Attorney, Agent, or Firm*—Edward M. Farrell; Herman Foster; Thomas I. Davenport

[57] ABSTRACT

In a railway truck, a primary suspension system comprising a pair of elastomeric half-ring members having high wear flexible woven material bonded thereto and on opposite sides thereof; the woven material having high flexibility and wear resistance perpendicular to the plane of the material and rigid within the plane of the material.

1 Claim, 9 Drawing Figures

FIG. 1
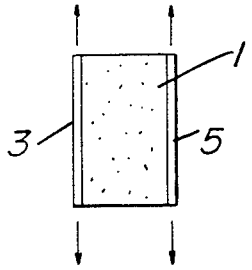
FIG. 1a
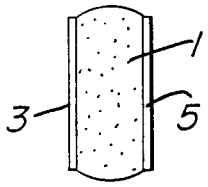
FIG. 1b
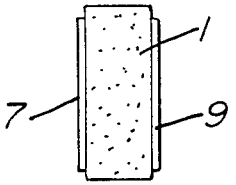
FIG. 4
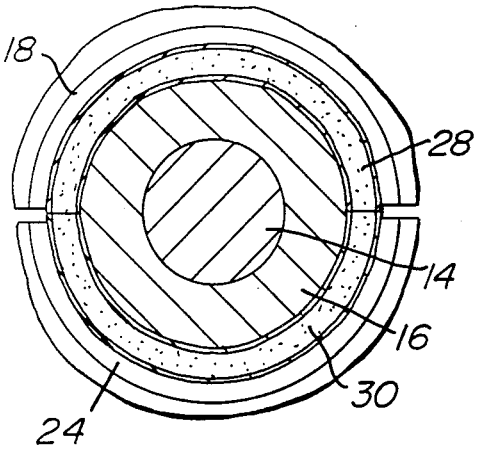
FIG. 5
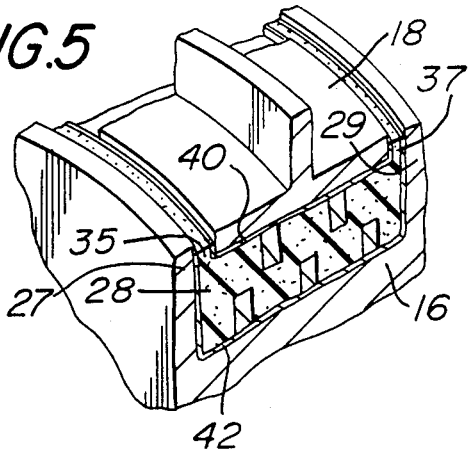
FIG. 6a
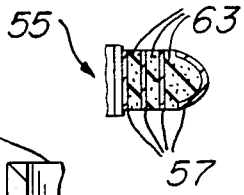
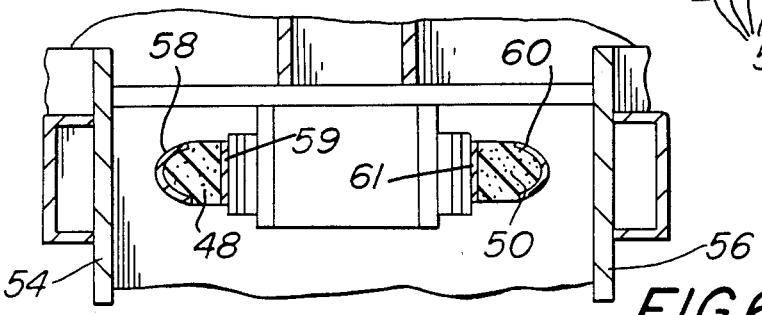
FIG. 6

FIG. 2
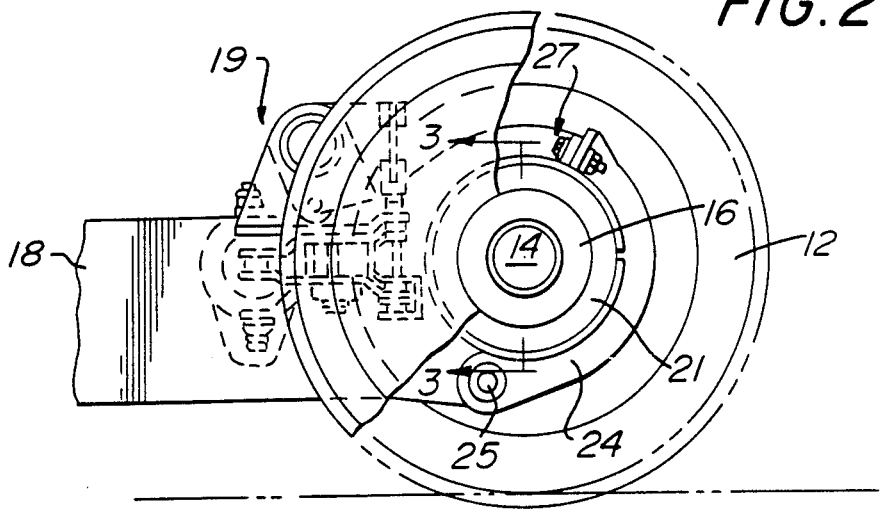
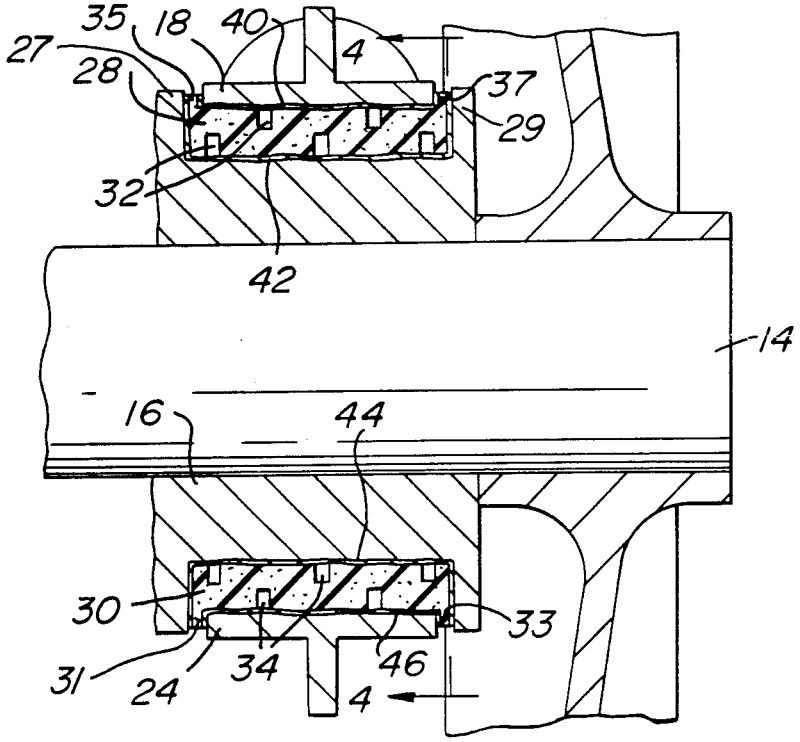
FIG. 3

ELASTOMERIC MEMBER HAVING FLEXIBLE WOVEN MATERIAL BONDED THERETO IN A RAILWAY TRUCK PRIMARY SUSPENSION SYSTEM

This is a substitute of application Ser. No. 612,822, filed May 22, 1984, abandoned.

BACKGROUND OF THE INVENTION

Elastomeric members are used extensively in railway cars and other systems where they are subjected to loads and deformations which tend to cause wear and require frequent replacements.

In railway car systems, for example, elastomeric members are employed in primary suspension systems. A particular type of system as related to the present invention, is described in a patent, assigned to the same assignee as the present invention, entitled "Primary Suspension System for a Railway Car", U.S. Pat. No. 4,444,122, issued Apr. 26, 1984.

An example of elastomeric bumpers, used as lateral stops, is illustrated in FIG. 4 of U.S. Pat. No. 4,192,238, issued Mar. 11, 1980.

Generally, in the case of soft primary suspension systems, the elastomeric members may include openings or voids therein to achieve greater softness and flexibility. With such openings, as described in the aforementioned patent, metal plates are bonded to the elastomeric members to prevent creeping of the elastomeric material under load conditions. When these plates are used, the various parts of the side frames into which the primary system is inserted must conform to high tolerances thereby adding to the overall manufacturing cost.

Because of the bonding of the elastomeric rings to the steel plates, it was possible to operate the primary suspension system with higher stresses or larger strains for the same forces by reducing the work in an area of the rubber ring thus providing softer spring rates. Because of the voids or cut-outs providing a softer spring and the bonding providing conditions preventing the bulging of the rubber areas of contact with the metal rings, the vertical stiffness of the primary suspension system described may be reduced to one-half or less over many designs in which compressed rubber rings were used in the primary suspension elements.

While the apparatus described in the aforementioned patent has proven satisfactory, the metal plates bonded to the elastomeric material required that the surfaces of the plate be maintained within certain tolerances to match the surfaces of the journal box and side frame between which the primary suspension system including the bonded plates are generally disposed.

OBJECTS OF THE INVENTION

It is an object of this invention to provide an improved elastomeric member having woven material on its surface which has high wear resistance perpendicular to the plane of the material and is rigid in the plane of the material.

It is a further object of this invention to provide an improved soft primary suspension for a railway car which eliminates the need for metal plates and minimizes tolerance requirements.

It is still a further object of this invention to provide an improved elastomeric member for lateral stop members in a railway car.

BRIEF SUMMARY OF THE INVENTION

In accordance with the present invention, an elastomeric member is adapted to deform under loads and resume its original shape after the loads have been discontinued. The member may include a plurality of cut-outs or voids to provide greater softness or flexibility. The surface of the elastomeric member includes a woven material, such as fiberglass or metal screening, which has high wear resistance perpendicular to the plane of the material and which is rigid in the plane of the material. The woven material prevents creeping of the elastomeric material in the member in the areas of the voids or cut-outs and creep due to the motion of the surface material with respect to the housing.

Other objects and advantages of the present invention will be apparent and suggest themselves to those skilled in the art from a reading of the following specification and claims, taken in conjunction with the accompanying drawings.

BRIEF DESCRIPTION OF THE DRAWINGS

FIGS. 1, 1*a* and 1*b* are diagrams presented for purposes of explanation;

FIG. 2 is a side view of a portion of a railway truck illustrating one embodiment of the present invention;

FIG. 3 is a cross-sectional view taken along lines 3—3 of FIG. 2 illustrating primary suspension systems;

FIG. 4 is a cross-sectional view taken along lines 4—4 of FIG. 3;

FIG. 5 is an isometric cross-section view of a portion of the primary suspension system illustrated in FIGS. 2 and 3;

FIG. 6 is a view, partly in cross-section, of another embodiment of the present invention; and FIG. 6*a* is a cross-sectional view of another embodiment of the present invention.

DESCRIPTION OF THE INVENTION

Referring to FIG. 1, an elastomeric member 1 includes surfaces of materials 3 and 5. The materials may be molded into or bonded to the elastomeric member 1. The material may be a woven material, such as fiberglass or metal screening, which has high resistance to wear. FIG. 1 illustrates the member 1 when there are no forces applied thereto.

FIG. 1*a* illustrates the elastomeric member 1 when forces are applied thereto between surfaces of material 3 and 5. The material 3 and 5 tend to prevent the elastomeric material in the member 1 from expanding in directions in the planes of the material 3 and 5.

FIG. 1*b* illustrates the member 1 disposed between, but not bonded to, two plates 7 and 9. In FIG. 1*b* the member 1 is subjected to forces, as in FIG. 1*a*. In FIG. 1*b* the elastomeric material movement in the planes of the plates 7 and 9 is not restricted.

FIGS. 1, 1*a* and 1*b* illustrate a condition in which woven material 3 and 5 molded into or bonded to an elastomeric member has high flexibility and wear resistance perpendicular to the plane of the materials 5 and 7 and which is rigid with respect to the planes of these materials.

Referring to FIG. 2, part of a typical railway truck for supporting a car body is illustrated. A single wheel-axle assembly, journal bearing assembly and primary system are illustrated, it being understood that a typical truck would include a pair of wheel-axle assemblies in which four primary suspension systems associated with each of the wheels on the truck would be used. Because the embodiment being described is directed to the elastomeric elements in the primary suspension system, a detailed description of all the elements on the truck will be omitted.

A wheel 12 is secured to an axle 14. A journal bearing assembly 16 receives the axle 14. The wheel-axle unit comprising the wheel 12 and axle 14 are secured to a side frame 18. The side frame 18 and other portions of the truck, not illustrated, are adapted to receive other equipment, such as braking units and other similar apparatus 19. A primary suspension system 21 is positioned between the journal bearing assembly 16 and the side frame 18. The primary suspension system 21 includes elastomeric elements towards which an important embodiment of the present invention is directed.

The wheel-axle assembly including the wheel 12 and axle 14 is connected to the side frame 18 by means of a clamp 24 adapted to be pivoted about a point 25. The clamp 24 is moved to a locked position. The clamp 24 is held secured to the frame by means of locking means 27 which may include a conventional head bolt, washer and lock nut.

Referring to FIGS. 3, 4 and 5, along with FIG. 2, the primary suspension 21 comprises a flexible ring made up of two elastomeric half rings 28 and 30. Each of the half rings 28 and 30 include a plurality of voids or cut-outs 32 and 34 respectively.

The two elastomeric half rings 28 and 30 are retained laterally by lip portions 27 and 29 extending outwardly from the main body of the bearing journal 16. The two elastomeric elements 28 and 30 also include lip portions 31, 33 and 35, 37 which extend outwardly to receive portions of the frame 18 and clamp 24 therebetween.

FIG. 4 illustrates the two half rings 28 and 30 disposed around the journal box assembly 16 to provide the primary suspension unit 21 (FIG. 2).

The external surfaces of the elastomeric element 28 includes fiberglass material 40 and 42 embedded therein or bonded thereto. This material extends to the lips 35 and 37. In like manner, the elastomeric element 30 includes a thin flexible high resistance fiberglass or metal screening material 44 and 46, which also extend to the lips 31 and 33. The material 40, 42, 44 and 46 may comprise woven fabric or screening type of material. The material provides a relatively thin coating on the surfaces of the elastomeric elements 28 and 30. The material 40, 42, 44 and 46 are wear resistance materials which protects the elastomer elements. As described in connection with FIGS. 1, 1*a* and 1*b*, the woven material has high flexibility and wear resistance perpendicular to the plane of the material and is rigid within the plane of the material.

The woven material prevents bulging in the area of the voids 32 and 34 in the elastomeric material when subjected to heavy car loads.

The surfaces of the side frame 18 and journal box assembly 16 contacted by the material 40 and 42, respectively, are illustrated in an exaggerated manner as comprising highly irregular or rough surfaces. In like manner, the journal box assembly 16 and clamp 24 of the side frame 18 have irregular surfaces in contact with the material 44 and 46 of the elastomeric half ring 30.

The elastomeric half rings 28 and 30 deform under pressure when assembled and are flexible to conform to the irregular surfaces in the journal box assembly 16 and clamp 24 of the side frame 18. Consequently, high tolerance between matching parts between the primary suspension system and side frame need not be maintained. In effect, the woven material may in some cases be used in place of metal plates bonded to the elastomeric rings, as described in the aforementioned patent.

The use of cut-outs or voids 32 and 34 in the elastomeric half rings 28 and 30 reduces the total elastomer area and increase the stresses and deflections under load. The cut-outs in the half rings 28 and 30 provide a lower spring rate in the vertical and longitudinal directions. The cut-outs 32 in the half ring 28 are illustrated in FIG. 5.

The embodiment of the invention described provides a different means, i.e., woven screen, for preventing bulging motion between elastomeric and metal surface in the area of the voids without using metal plates.

Referring to FIG. 6, a portion of a railway car is illustrated. A pair of elastomeric members 48 and 50 are connected to a bolster 52. The members 48 and 50 act as lateral bumpers to limit the lateral movement of the car body. Stop members 54 and 56 are connected to the car body. The lateral movements of the car body are limited when either of the elastomeric members 48 or 50 contact one of the stop members 54 or 56.

Material 58 and 59 are embedded or bonded to the elastomeric member 48. Material 60 and 61 are embedded or bonded to the elastomeric member 50. The woven material 58, 59, 60 and 61 provide high wear surfaces for the members 48 and 50.

The elastomeric members 48 and 50 are restored to their original shapes after they are deformed by bumping actions. The overall result is little wear, high capacity and less need for replacements of the members 48 and 50 because of the materials 58, 59, 60 and 61.

FIG. 6*a* illustrates another type of bumper 55 in which multiple layers of woven material 57 are embedded into an elastomeric body 63. The multiple layers provide a more durable bumper without adversely affecting its operating characteristics.

The woven material, fiberglass or metal screening, may be embedded in the elastomeric members during a modling operation. In some cases, the material may be bonded to the elastomeric member. The material may take different forms dependent upon the wear and flexibility requirements. The thickness of the materials may also vary in accordance with design requirements.

What is claimed is:

1. In a railway truck including a side frame with a clamp to receive a journal bearing assembly for an axle, a primary suspension system disposed between said journal bearing assembly and said side frame and clamp comprising:

(a) a pair of elastomeric half-ring members disposed between said journal box assembly and said side frame and clamp;

(b) the opposite surfaces of each of said elastomeric members including high wear flexible woven material bonded thereto;

(c) each of said elastomeric half-ring members including lip portions extending outwardly to receive portions of said side frame and said clamp therebetween with said lip portions including woven material bonded thereto;

(d) said elastomeric members further including voids therein:

(e) said woven material preventing bulging in the areas of said voids of the elastomeric material when subjected to heavy car loads, and (f) said elastomeric members conforming to irregular surfaces in said journal box assembly said side frame and said clamp.

* * * * *